US011624106B2

(12) United States Patent
Pershing et al.

(10) Patent No.: US 11,624,106 B2
(45) Date of Patent: Apr. 11, 2023

(54) CARBURIZED STEEL COMPONENT AND CARBURIZATION PROCESS

(71) Applicant: Caterpillar Inc., Peoria, IL (US)

(72) Inventors: Michael A. Pershing, Washington, IL (US); Curtis A. Henning, Dunlap, IL (US); Robert J. Pickerill, Peoria, IL (US); Scott A. Johnston, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 104 days.

(21) Appl. No.: 16/822,753

(22) Filed: Mar. 18, 2020

(65) Prior Publication Data

US 2021/0292880 A1 Sep. 23, 2021

(51) Int. Cl.

| | |
|---|---|
| ***C23C 8/22*** | (2006.01) |
| ***C22C 38/48*** | (2006.01) |
| ***C22C 38/44*** | (2006.01) |
| ***C22C 38/02*** | (2006.01) |
| ***C21D 9/46*** | (2006.01) |
| ***C22C 38/04*** | (2006.01) |

(52) U.S. Cl.

CPC ..... *C23C 8/22* (2013.01); *C21D 9/46* (2013.01); *C22C 38/02* (2013.01); *C22C 38/04* (2013.01); *C22C 38/44* (2013.01); *C22C 38/48* (2013.01); *C21D 2211/001* (2013.01); *C21D 2211/008* (2013.01); *C22C 2204/00* (2013.01)

(58) Field of Classification Search

CPC ..... C23C 8/22; C23C 30/005; C23C 8/20; C21D 1/06; C21D 1/19; C21D 1/25; Y10T 428/26

USPC ..... 148/319

See application file for complete search history.

(56) References Cited

U.S. PATENT DOCUMENTS

| | | | |
|---|---|---|---|
| 4,921,025 | A | 5/1990 | Tipton et al. |
| 4,971,634 | A | 11/1990 | Shibata et al. |
| 5,595,610 | A | 1/1997 | Maeda et al. |
| 5,658,082 | A | 8/1997 | Tsushima et al. |

(Continued)

FOREIGN PATENT DOCUMENTS

EP 0033403 A1 8/1981

OTHER PUBLICATIONS

Ooki, C. et al., "Improving Rolling Contact Fatigue Life of Bearing Steels Through Grain Refinement," *NTN Technical Review*, vol. 71, pp. 2-7 (2004).

*Primary Examiner* — Jie Yang

(74) *Attorney, Agent, or Firm* — Bookoff McAndrews PLLC

(57) ABSTRACT

A carburized steel component, comprising a steel base including, by weight percent, from 0.08% to 0.35% carbon, 0.5% to 1.3% manganese, 0% to 0.35% silicon, 0.2% to 2.0% chromium, 0% to 4% nickel, 0% to 0.50% molybdenum, 0% to 0.06% niobium, and a remaining weight percent of iron, and a carburized layer of above 0.35% by weight carbon from a surface of the carburized layer to a carburized layer depth, wherein the carburized layer depth is from 0.5 mm to 3.0 mm, wherein the carburized layer comprises a microstructure including martensite, retained austenite, carbide, and less than 2% by volume non-martensitic transformation products (NMTP), and wherein the carburized layer includes a prior austenite average grain size of 3.0-8.0 microns from the surface to a depth of at least 0.2 mm.

19 Claims, 4 Drawing Sheets

(56) References Cited

U.S. PATENT DOCUMENTS

| | | | | |
|---|---|---|---|---|
| 5,910,223 | A | 6/1999 | Tipton et al. | |
| 5,944,916 | A | 8/1999 | Chung | |
| 6,149,734 | A | 11/2000 | Isogai et al. | |
| 6,258,179 | B1 * | 7/2001 | Takayama | C23C 8/22 148/216 |
| 6,309,475 | B1 | 10/2001 | Takayama et al. | |
| 6,325,867 | B1 | 12/2001 | Okita et al. | |
| 6,447,619 | B1 | 9/2002 | Takayama et al. | |
| 7,169,238 | B2 | 1/2007 | Walenta et al. | |
| 10,344,801 | B2 | 7/2019 | Ohki | |
| 2004/0170348 | A1 | 9/2004 | Okugami et al. | |
| 2005/0257860 | A1 * | 11/2005 | Takayama | C22C 38/04 148/572 |
| 2013/0146181 | A1 * | 6/2013 | Kubota | C22C 38/42 148/219 |

* cited by examiner

CARBURIZED STEEL COMPONENT AND CARBURIZATION PROCESS

TECHNICAL FIELD

The present disclosure relates generally to heat treated steel components, and more particularly, to carburized steel components having fine grain carburized layers that improve surface contact fatigue performances, and to a carburization process yielding such components.

BACKGROUND

Steel articles and components, such as gears, shafts, and those acting as bearings, are often implemented in various machineries, mechanical devices, systems, etc. Constant engagement between the surfaces of these various steel components and ordinary wear may result in surface contact fatigue, resulting in damage, e.g., pitting, spalling, etc., to contacting surfaces. To improve the surface contact fatigue lives, steel components may undergo a process of carburization. Carburization is an effective method of increasing surface hardness of low carbon steels by increasing the carbon content in the exposed steel surfaces. Thus, carburization may result in steel components having harder, wear resistant cases/layers. Carburization generally entails steel being placed in an atmosphere containing carbon in an amount greater than the base carbon content of the steel, and heated to a temperature above the austenite transformation temperature of steel. After the desired amount of carbon has been diffused into the steel to a predetermined depth, hardness is induced by cooling the steel, e.g., quenching.

U.S. Pat. No. 4,921,025, filed by Tipton et al. ("the '025 patent"), describes a carburized low silicon steel article having no more than 0.1% silicon, and a carbon content of 0.08 to 0.35%. There are various carburized steel articles/parts and prior carburization processes of said articles/parts, such as those disclosed in the aforementioned patent. Nevertheless, there remains a need for additional development in this area. In furtherance of this need, the present disclosure describes a carburized steel component and the carburization process thereof.

The carburized steel components and carburization process of the present disclosure may solve one or more of the problems in the art. The scope of the current disclosure, however, is defined by the attached claims, and not by the ability to solve any specific problem.

SUMMARY

According to an example, a carburized steel component may comprise a steel base including, by weight percent, from 0.08% to 0.35% carbon, 0.5% to 1.3% manganese, 0% to 0.35% silicon, 0.2% to 2.0% chromium, 0% to 4% nickel, 0% to 0.50% molybdenum, 0% to 0.06% niobium, and a remaining weight percent of iron and a carburized layer of above 0.35% by weight carbon from a surface of the carburized layer to a carburized layer depth, wherein the carburized layer depth is from 0.5 mm to 3.0 mm. The carburized layer may comprise a microstructure including martensite, retained austenite, carbide, and less than 2% by volume non-martensitic transformation products (NMTP), and may include a prior austenite average grain size of 3.0-8.0 microns from the surface to a depth of at least 0.2 mm.

In another example, the carburized layer may further include a carbide particle count over 350 per a 200 square micron field from the surface of the carburized layer to the depth of 0.2 mm. The carburized layer may further include a carbide particle count from 400 to 500 per a 200 square micron field as measured at a depth of 0.1 mm from the surface. The carburized layer may further include a carbide area fraction over 7.5% from the surface of the carburized layer to the depth of 0.2 mm. The carburized layer may further include a carbide area fraction from 7.5% to 15% from the surface of the carburized layer to a depth from 0.1 mm to 0.2 mm.

In another example, the carburized layer may have a HRC surface hardness of at least 63, and a microhardness (HV), taken on a cross-section, of at least 772 from the surface of the carburized layer to the depth of 0.2 mm. Furthermore, 70% of carbides of the carburized layer may have a minimum area of 0.01 $\mu m^2$ to 0.10 $\mu m^2$ from the surface of the carburized layer to a depth from 0.05 mm to 0.2 mm.

According to another example, the steel base may include, by weight percent, from 0.18% to 0.23% carbon, 0.8% to 1.20% manganese, 0% to 0.35% silicon, 0.65% to 1.0% chromium, 0.15% to 0.45% nickel, 0.02% to 0.08% molybdenum, 0% to 0.06% niobium, and a remaining weight percent of iron.

According to an example, a carburized steel component may comprise a steel base including, by weight percent, from 0.08% to 0.35% carbon, 0.5% to 1.3% manganese, 0% to 0.35% silicon, 0.2% to 2.0% chromium, 0% to 4% nickel, 0% to 0.50% molybdenum, 0% to 0.06% niobium, and a remaining weight percent of iron, and a carburized layer, wherein the carburized layer comprises a microstructure including martensite, retained austenite, carbide, and less than 2% by volume non-martensitic transformation products (NMTP), and wherein the martensite has a needle length of 1 to 5 microns.

According to an example, a method of manufacturing a carburized steel component may comprise selecting a steel material having, by weight percent, from 0.08% to 0.35% carbon, 0.5% to 1.3% manganese, 0% to 0.35% silicon, 0.2% to 2.0% chromium, 0% to 4% nickel, 0% to 0.50% molybdenum, 0% to 0.06% niobium, and a remaining weight percent of iron, shaping the steel material to form a component, carburizing the steel component in the temperature range of 900° C. to 1000° C. until forming a carburized layer 0.5-3.0 mm deep, and the carburized layer has a carbon content above 0.35%, by weight, of carbon, cooling the carburized component to below 100° C., reheating the cooled carburized component at a temperature above 760° C., and re-cooling the carburized steel component via quenching.

In another example, the cooling after the carburizing may be via quenching, and the carburized layer may have a hardness of at least HRC 57 prior to the reheating. The reheating may be at a temperature from 760° C. to 830° C. The carburizing may be in an atmosphere with a carbon potential above 1.00. The reheating may be in an atmosphere with a carbon potential from 0.95 to 1.05. The atmosphere may be an endothermic generated atmosphere with a composition including $H_2$, $N_2$, CO, CO2, and water vapor.

DETAILED DESCRIPTION

Figure 1A:
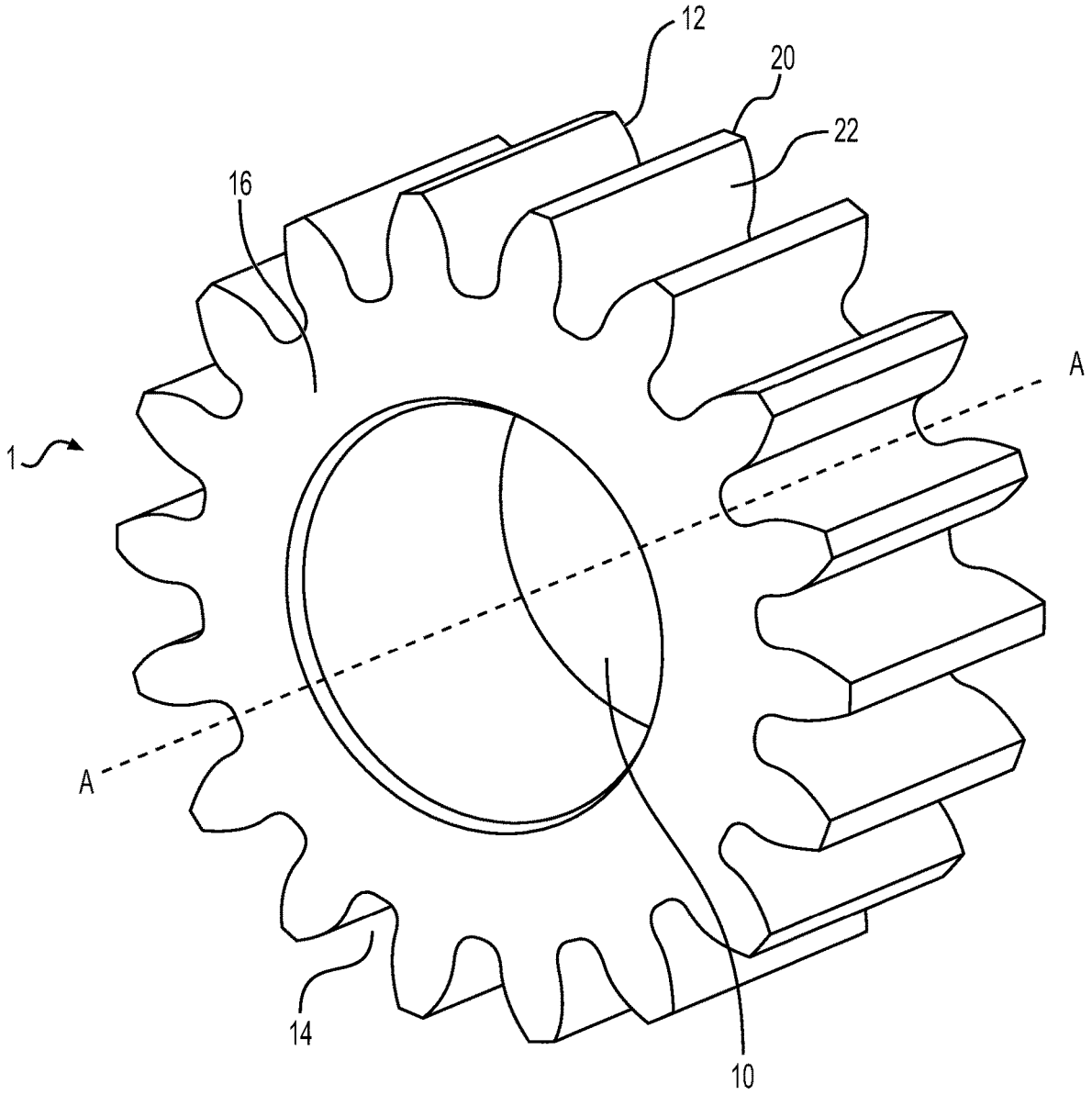
FIGS. 1A and 1B are, respectively, a perspective view and a cross-sectional view of an exemplary fine grain carburized steel gear, according to aspects of this disclosure.

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

In this disclosure, relative terms, such as, for example, "about," "substantially," and "approximately" are used to indicate a possible variation of ±10% in a stated value. Although the current disclosure will be described with reference to a carburized steel gear, this is only exemplary. In general, the current disclosure can be applied as to any carburized steel article or component, such as, for example, a shaft, cylinder, roller, sleeve, joint, and any other steel part that may be used or implemented in devices or machinery.

Aspects of this disclosure also describe features, e.g. carbide particle count, and area fraction of carbide, which were measured via the use of a Scanning Electron Microscope (SEM). The use of a SEM to determine the aforementioned features entails the following procedures: 1) The sample is sectioned and mounted in electrically conductive metallographic mounting compound. 2) The mounted sample is metallographically prepared through a sequence of grinding and polishing operations ending with a 1 μm suspension polish. 3) The mounted and polished sample is etched using ~2% nital solution in a manner comparable to that needed to evaluate a standard carburized and hardened microstructure. 4) The sample is evaluated in a SEM using secondary electron detection with parameters adjusted to provide maximum contrast between carbide particles and the surrounding matrix material. 5) A series of SEM images are taken from the sample surface to a depth of 300 μm in steps of 50 μm and then to a depth of 600 μm in steps of 100 μm. Magnification on each image is such that it shows a field of ~17 μm×11.9 μm (202 $\mu m^2$). 6) Image analysis software (e.g., ImageJ or other conventional image analysis software) is used to pick carbide particles out from the surrounding matrix material and to perform a particle analysis to determine the count and area fraction of carbides in the field of view. This analysis includes a particle size threshold to exclude particles with an area of less than 0.01 $\mu m^2$. Depending on image quality and contrast, it may be necessary to adjust image sharpness, "enhance local contrast," or "de-speckle" in order for the particle analysis function in ImageJ to correctly identify all carbides. In certain cases, it may be necessary to manually "fill in" larger carbides or "erase" spots in the matrix in order for the particle analysis to correctly identify all carbides. It is recommended that the particle analysis report include the "Show Outlines" option to generate an image showing the particles counted, and that this image be compared back to the original SEM image to verify that the proper particles are being counted. 7) Steps 3)-5) are repeated in a second location on the mounted sample. 8) An average of the two evaluated locations is used for determining the carbide count and volume fraction.

The above-described technique may also be applied in determining the proportion of the fine grain microstructure composition, e.g., an amount of non-martensitic transformation products (NMTP). For example, a polished cut cross-section from the surface of the carburized layer may be evaluated via a SEM, as described above. However, the carburized layer sample is not limited to being evaluated via a SEM, and any suitable optical microscope may be used as well. Image analysis software (e.g., ImageJ or other conventional image analysis software) may be used to pick non-martensitic transformation products, e.g., bainite or pearlite, out from the surrounding matrix material and to perform an analysis to determine the area percentage of NMTP in the field of view. It is further noted that an area percentage of NMTP may be synonymous with a weight percentage of the NMTP, or a volume percentage of the NMTP. For example, less than 2% by volume NMTP may also mean less than 2% by weight NMTP, or less than 2% by area NMTP.

FIG. 1A illustrates a perspective view of an exemplary carburized steel component 1, for example, a gear, according to the present disclosure. Component 1 includes a body 16, and a plurality of teeth 12 circumferentially arranged around body 16. Body 16 is annular and includes a central opening 10, through which a central axis A may extend. Component 1 further includes a plurality of gaps 14 in between each of teeth 12.

Figure 1B:
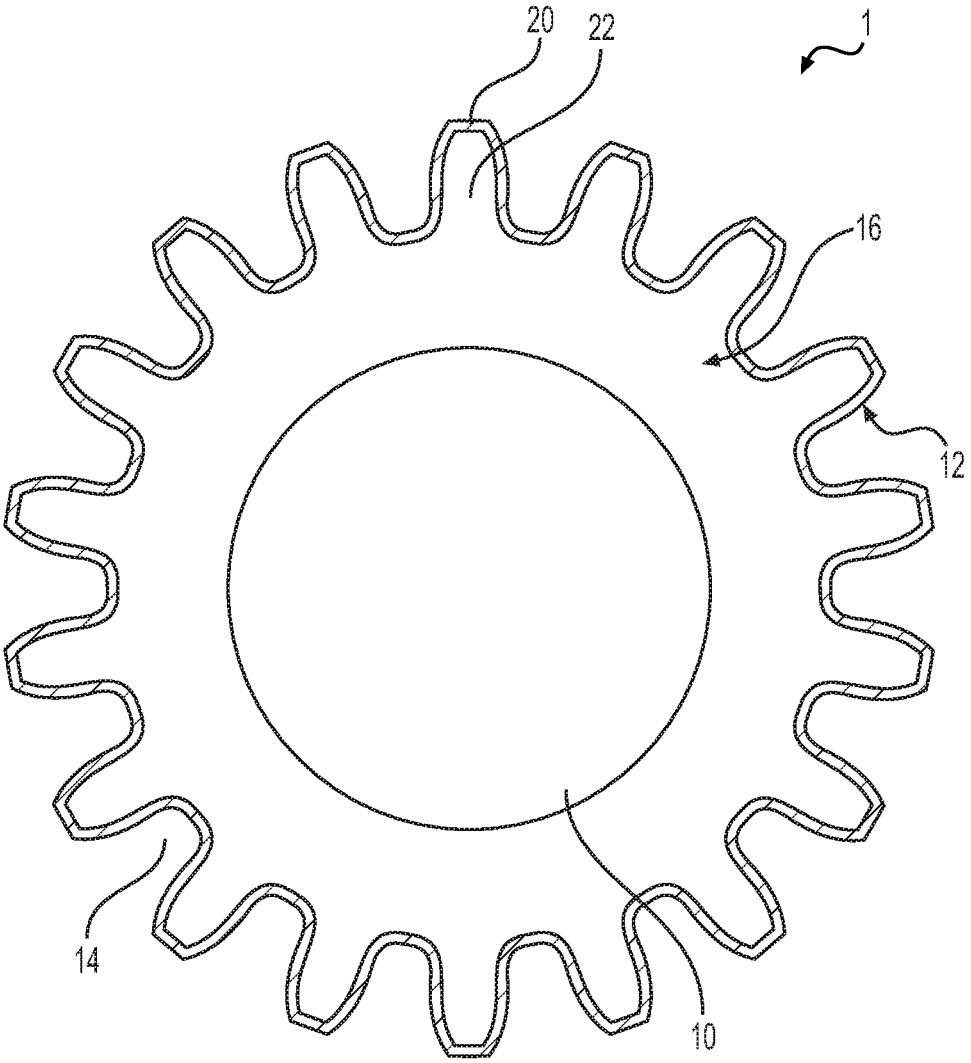

As shown in FIG. 1B, component 1 comprises a carburized steel layer 20 and a steel base 22. As a result of its steel base composition and its carburized layer having a fine grain microstructure, component 1 exhibits enhanced properties, e.g., higher surface contact fatigue performance, as further discussed below when referring to FIG. 3. For example, steel base 22 may have a composition, by weight percentage, within about the following ranges:

| | |
|---|---|
| Carbon (C) | 0.08%-0.35% |
| Manganese (Mn) | 0.5%-1.3% |
| Silicon (Si) | 0%-0.35% |
| Chromium (Cr) | 0.2%-2.0% |
| Nickel (Ni) | 0%-4% |
| Molybdenum (Mo) | 0.0%-0.50% |
| Niobium (Nb) | 0%-0.06% |
| Aluminum (Al) | 0%-0.08% |
| Iron (Fe) | Balance |

In some other exemplary embodiments, the base steel material may have a composition, by weight percent, from 0.18% to 0.23% carbon, 0.8% to 1.20% manganese, 0% to 0.35% silicon, 0.65% to 1.0% chromium, 0.15% to 0.45% nickel, 0.15% to 0.45% molybdenum, 0.02% to 0.08% aluminum, 0% to 0.06% niobium, and a remaining weight percent of iron. Such a steel composition may include a steel composition such as steel composition 4120 or 4130.

Carburized layer 20 of component 1 may be of a thickness that is predetermined during the carburization process. In some exemplary embodiments, carburized layer 20 may be defined by a depth of a layer that is equal to 0.35% C or above. In some other exemplary embodiments, carburized layer 20 may be defined by a depth of a layer that is equal to 0.35% C or above, if base carbon is also below 0.25% C. Such a depth may result in a carburized layer thickness of approximately 0.5-3.0 mm. As a result of carburization, the composition of carburized layer 20 may vary from that of aforementioned steel base 22. For example, carburized layer 20 may include a carbon content, in weight percentage, within about 0.9%-1.60% from the surface of component 1 through a depth of 0.3 mm. Additionally, in other exemplary embodiments, carburized layer 20 may further include a nitrogen content, in weight percentage, within about 0%-0.5% from the surface of component 1 through a depth of 0.1 mm. However, it is noted that the contents of carbon and nitrogen within carburized layer 20 may vary if carburized layer 20 is grinded into a ground state. For example, in some embodiments, carburized layer 20 may be ground, thereby removing a surface layer of about 0.1 mm. In such exemplary embodiments, carburized layer 20 may have a carbon content within about 0.9%-1.10% from the new surface of component 1 through a depth of 0.2 mm-0.3 mm. Additionally, in such exemplary embodiments, carburized layer 20 may have a negligible nitrogen content due to the ground removal of about 0.1 mm from the surface of layer 20. It is also noted that carburized layer 20 is not limited to the aforementioned elements and contents, and may include additional elements in varying contents as well. This variation in carbon content between carburized layer 20 and base 22 may be attributed to the carbon potential that exists during carburization, between the heating atmosphere and steel. Further detail concerning the carbon potential and heating atmosphere are discussed below, when referring to FIG. 2.

Carburized layer 20 of component 1 may further exhibit a fine grain microstructure including martensite, retained austenite, and carbide. For example, the fine grain microstructure may include a proportion of at least 7% carbide, 70-90% martensite, some retained austenite, and less than 2% by volume of non-martensitic transformation products (typically bainite and pearlite). Said percentages by volume (e.g., area percentage or weight percentage) may be obtained via the use of a SEM or optical microscope, as discussed in further detail above. In some other exemplary embodiments, the fine grain microstructure may include a proportion of 7-25% carbide, or 7.5-15% carbide. The average prior austenite grain diameter may be about 3-8 microns, as defined by the mean grain diameter (d) using the Heyn Lineal Intercept Procedure defined in ASTM E112. This procedure may be performed on a component specimen etched with the Prior Austenite Grain Size (PAGS) etch procedure that includes 1-6% picric acid in water with overetch and backpolish techniques to reveal prior austenite grains well enough to count intercepts with the Heyn Lineal Intercept Procedure. By undergoing fine grain carburization, the 3-8 micron prior austenite grain diameter may produce a martensite having a finer needle length of 1-5 microns. Meanwhile, about 70% of carbides may show individual sectioned areas of 0.01-0.10 $\mu m^2$ within a depth range of 0.05 mm-0.2 mm. Thus, carburized layer 20 may demonstrate a finer microstructure, relative to the steel grain size before heat treatment and relative to conventional carburizing processes. Furthermore, carburized layer 20 may exhibit a minimal amount of retained austenite and non-martensitic transformation products.

The carbides precipitated in carburized layer 20 may be dispersed uniformly or sporadically throughout the martensitic matrix. The carbides may be dispersed such that the carbide particle count per a 200 square micron field is, for example, greater than 350. In other exemplary embodiments, the carbide particle count, may vary along a gradient. For example, the carbide particle count per a 200 square micron field may be 400-500 at a 0.1-0.3 mm depth, and 450-650 at a 0.05 mm depth from the surface of layer 20. However, as noted above, layer 20 may be in a ground state. Thus, the carbide particle count of a ground layer 20 may be reduced in accordance with the degree by which layer 20 is grounded, e.g., 0.1 mm. For example, in some embodiments, the carbide particle count of layer 20, grounded by an amount of 0.1 mm, may be 400-500 at about a 0.2 mm-0.3 mm depth from the grounded surface of layer 20.

The carbides may also be dispersed such that an area fraction of the carbides, from the surface to a depth of 300 microns, may be above 7.5%. In some exemplary embodiments, the area fraction of the carbides may be about 7.5%-12.5%, although it may exceed 15% at the surface of layer 20. In some other exemplary embodiments, in which layer 20 is ground so that 0.1 mm-0.2 mm of the surface is removed, the area fraction of carbide may be 7.5%-12.5% at the ground surface, and 3%-10% at depths of 100-300 microns. The aforementioned carbide features (particle count and area fraction) may be detected and determined via the use of a SEM, as described in detail above.

As a result of carburized layer 20 having such composition and characteristics, carburized layer 20 may demonstrate enhanced surface hardness. For example, the surface of carburized layer 20 may exhibit a Rockwell hardness (HRC) of at least 63. In other exemplary embodiments, the HRC may be from about HRC 64-67. In another example, carburized layer 20 may also exhibit a Vickers pyramid number (HV), i.e., microhardness, of at least 772. The microhardness (HV) may be taken on a polished cut cross-section from the surface of the carburized layer to a depth of at least 0.2 mm. In other exemplary embodiments, the HV may be from about 800-940. The HV may be taken on a polished cross-section of the first 0.2 mm depth of carburized layer 20.

Figure 2:
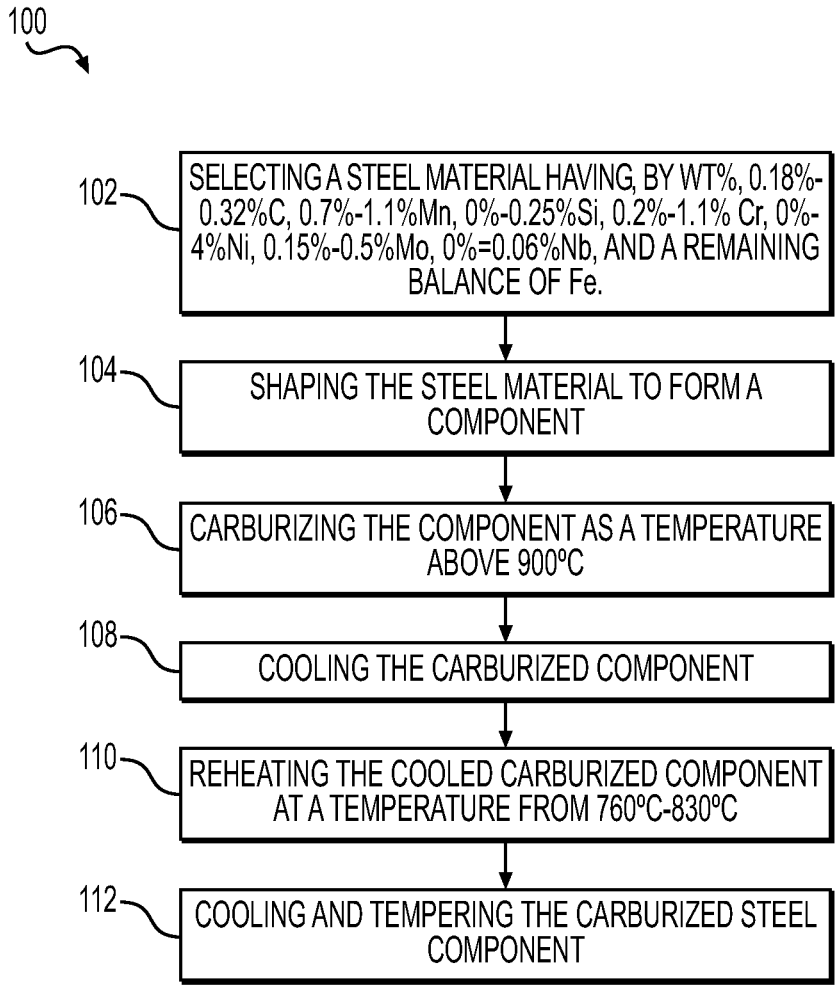
FIG. 2 provides a flowchart depicting an exemplary process for carburizing a steel component, according to aspects of this disclosure.

FIG. 2 is a flow diagram portraying an exemplary carburization process 100 that may be performed to carburize a steel component or article, such as component 1 of FIG. 1. As a result of carburization process 100, said steel component or article becomes carburized, having the composition and characteristics of the above-described component 1.

Process 100 includes a step 102, in which an initial, base steel material is selected. For example, the base steel material may have a composition, by weight percentage, within about the following ranges:

| | |
|---|---|
| Carbon (C) | 0.08%-0.35% |
| Manganese (Mn) | 0.5%-1.3% |
| Silicon (Si) | 0%-0.35% |
| Chromium (Cr) | 0.2%-2.0% |
| Nickel (Ni) | 0%-4% |
| Molybdenum (Mo) | 0.0%-0.50% |
| Niobium (Nb) | 0%-0.06% |
| Aluminum (Al) | 0%-0.08% |
| Iron (Fe) | Balance |

In some other exemplary embodiments, the base steel material may have a composition, by weight percent, from 0.18% to 0.23% carbon, 0.8% to 1.20% manganese, 0% to 0.35% silicon, 0.65% to 1.0% chromium, 0.15% to 0.45% nickel, 0.15% to 0.45% molybdenum, 0.02% to 0.08% aluminum, 0% to 0.06% niobium, and a remaining weight percent of iron. Such a steel composition may include a steel composition such as steel composition 4120 or 4130.

Process 100 also includes a step 104, in which the steel material is shaped to form a component. The manner or mechanism by which the steel material is shaped is not particularly limited. Furthermore, the component to which the steel material is shaped into is not limited as well. As discussed above, the steel component a shaft, cylinder, roller, sleeve, joint, and any other steel part that may be used or implemented in devices or machinery.

After step 104, process 100 includes a step 106 of carburizing the steel component at a temperature above 900°

C., or in some examples, from about 900° C. to 1000° C. The manner or method by which the steel component is carburized is not particularly limited, so long as the carburization imparts a suitable amount of carbon onto the steel component, e.g., vacuum carburization, gas carburization, etc. For example, carburization step 106 may entail the steel component being heated in an atmosphere with carbon potential. As a result, the carbon from the atmosphere may diffuse into the surface to a depth of 0.5 mm to 3.0 mm such that a weight percent of carbon is 0.35% C or above at the "carburized depth". The atmosphere, in which the steel component is carburized, may be, for example, a hydrocarbon atmosphere. The hydrocarbon atmosphere may include, but is not limited to, carbon monoxide, hydrogen, carbon dioxide, and hydrocarbons, such as methane, nitrogen, and water vapor. For example, the hydrocarbon atmosphere an endothermic generated atmosphere including about 40% $H_2$, 40% $N_2$, 20% CO, with trace $CO_2$, 0.1-2.0% $CH_4$, and trace water vapor. In some examples, the carbon potential of the hydrocarbon atmosphere may be above 1.00 CP. However, it is noted that the atmosphere could be low pressure carburizing hydrocarbons such as acetylene (LPC processing). As a result of step 106, an initial carburized layer of the steel component may be formed, and said layer may include a carbon content, in weight percentage, within about 0.9-1.3 wt. % from the surface of through a depth of 0.3 mm to 0.4 mm.

Process 100 includes a subsequent step 108 of cooling the carburized steel component. The manner by which the carburized steel component is cooled is not particularly limited, and may be, for example, via quenching. The carburized steel component may be cooled, e.g., quenched, until it achieves a hardness of at least HRC 57 from the surface to a depth of 0.5 mm to 3.0 mm. As a result of the cooling, an initial carburized layer, having a depth of 0.5 mm to 3.0 mm, may have a weight percent of carbon that is at least 0.35% C.

Process 100 additionally includes a step 110 of reheating the cooled component. Specifically, the cooled carburized component may be reheated at a temperature from about 760° C. to 830° C. The manner or method by which the steel component is again reheated is not particularly limited, so long as the reheating is done in a manner that minimizes the loss of surface carbon, e.g., the surface carbon does not fall below a weight percent of 0.8% and is sufficient to transform the carburized layer to austenite. In some examples, ammonia may also be added to the atmosphere during reheating. The ammonia may be a source of nitrogen that is imparted onto a surface of the carburized layer, for example, 0.1-0.4%, by weight. At the end of reheating step 110, the austenite grain size (average prior austenite grain diameter) of the carburized layer may be about 3-8 microns, as defined by the mean grain diameter (d) using the Heyn Lineal Intercept Procedure discussed above. For example, the carburized layer may have a prior austenite average grain size of 3.0-8.0 microns from the surface to at least a depth of 0.2 mm.

As a result of additional carbon diffusion in steps 106 and 110, the carburized layer of the steel component may have an increased carbon content, in weight percentage, within about 0.9%-1.60% from the surface through a depth of 0.3 mm. Additionally, the carburized layer may further include a nitrogen content, in weight percentage, within about 0%-0.5% from the surface of component 1 through a depth of 0.1 mm. Additionally, due to the reheating, carbides may be further precipitated such that the carbide particle count per a 200 square micron field is greater than 350. Furthermore, an area fraction of the carbides, from the surface to a depth of 300 microns, may be over 10%.

Furthermore, as a result of the above discussed steps, the carburized layer may also exhibit a fine grain microstructure including martensite, retained austenite, and carbide. For example, the fine grain microstructure may include a proportion of at least 7% carbide, 70-90% martensite, some retained austenite, and less than 2% by volume of non-martensitic transformation products (typically bainite and pearlite). Said percentages by volume (e.g., area percentage or weight percentage) may be obtained via the use of a SEM or optical microscope, as discussed in further detail above. In some exemplary embodiments, the fine grain microstructure may include a proportion of 7-25% carbide, or 7.5-15% carbide. The 3-8 micron prior austenite grain diameter may result in a finer martensite having a needle length of 1-5 microns. Carbides, meanwhile, may show individual sectioned areas of 0.01-0.20 $\mu m^2$. Thus, in addition to the carbide particle count discussed above, the carburized layer may also exhibit a fine grain microstructure, and a minimal amount of retained austenite and non-martensitic transformation products.

After reheating, process 100 includes a step 112 of quenching and tempering the carburized steel component at a temperature from about 0° C. to around 200° C.

Thus, process 100, as disclosed above, may provide the steel component a carburized layer having a plurality of characteristics and properties that enhances the layer's functionality, e.g., hardness, surface contact fatigue lifespan.

It is further noted that a carburized steel component, resulting from process 100, may be subject to a grinding process. The grinding process may remove a surface layer from the carburized layer of the steel component. The amount of surface layer removed via grinding is not particularly limited, and may be any suitable amount, e.g., 0.1 mm. As a result of the grinding, it is noted that the contents of carbon, nitrogen, and carbide particles in a carburized layer may vary, as detailed above in the discussion of carburized layer 20 of FIGS. 1A-1B.

Hereinafter, the effects of an aspect of the present disclosure will be described in detail with reference to the following examples and FIG. 3. However, the condition in the examples is an example condition employed to confirm the operability and the effects, e.g., surface contact fatigue performance, of the present disclosure, so that the present disclosure is not limited to the examples further described below. The present disclosure can employ various types of conditions as long as the conditions do not depart from the scope of the present disclosure and can achieve the object(s) of the present disclosure.

Example 1

4122 grade steel components (steel rollers) were carburized in a hydrocarbon atmosphere with carbon potential above 1.00 CP for enough time to develop the desired carburized case depth (thickness) of approximately 1.5 mm. The carburized steel rollers were subsequently cooled to room temperature. The steel rollers were reheated to a constant temperature in the range of 760° C.-830° C. in a hydrocarbon atmosphere with carbon potential near 1.00 CP. Subsequently thereafter, the steel rollers were quenched in oil. The carburized case of the steel rollers of Example 1 exhibited a mean grain diameter of 5-6 microns, a carbide count above 350 in a 200 micron square area, and an area fraction of carbides, from the surface to a depth of 300 microns, over 10%.

Comparative Example 1

4122 grade steel components (steel rollers) were carburized in a hydrocarbon atmosphere with carbon potential above 1.00 CP for enough time to develop the desired carburized case depth (thickness) of approximately 1.5 mm. The carburized steel rollers were gas cooled to room temperature. The steel rollers were subsequently reheated at a temperature of 850° C. in a hydrocarbon atmosphere with a carbon potential near 0.80 CP, Subsequently thereafter, the steel rollers were quenched in oil. The carburized case of the steel rollers of Comparative Example 1 exhibited a mean grain diameter of 12-14 microns. The steel rollers exhibited a carbide count of below 250 in a 200 square micron area and the area % carbide was less than 10%.

Testing and Results

The comparative testing process involved running a large diameter, e.g., approximately 125 mm, load roller made from hardened 52100 steel against smaller diameter, e.g., approximately 25 mm, test rollers of Example 1 and Comparative Example 1. After heat treatment, both rollers of Example 1 and Comparative Example 1 were ground to achieve a consistent surface finish. The rollers were then put on a test machine that ran the load roller against the rollers of Example 1 and Comparative Example 1. The test machine ran until the test machine detected a surface contact fatigue (pitting) failure develop on the rollers. After detection, the test machine shut down, while also logging the number of cycles needed to reach the detected failure. This process was repeated until sufficient data points were generated and a Weibull plot was produced from the data.

Figure 3:
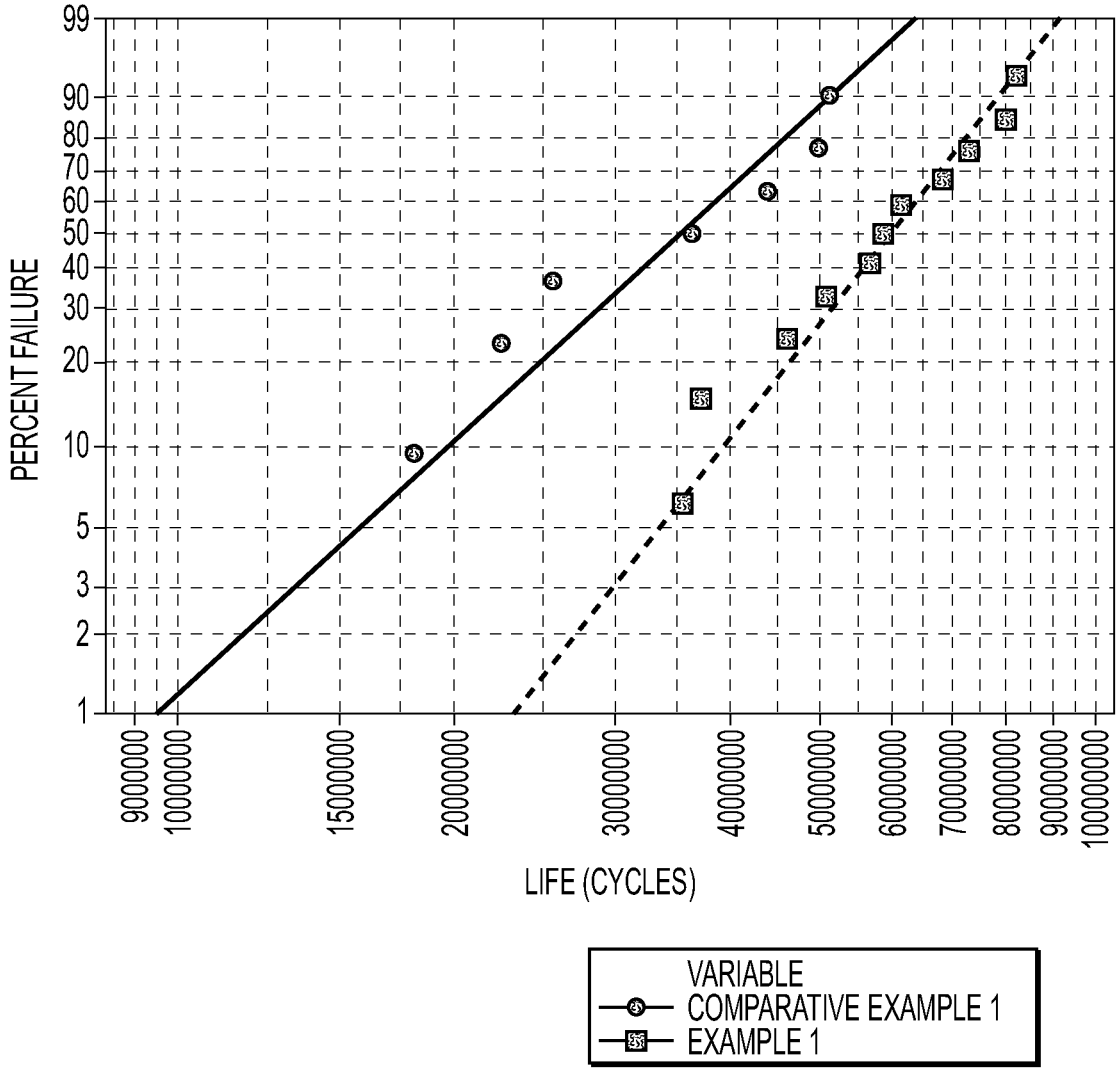
FIG. 3 is a graph illustrating comparative data of surface contact fatigue performance between examples of steel components subjected to varying carburization processes.

As shown in the Weibull plot of FIG. 3, the rollers of Example 1 exhibited greater surface contact fatigue lifespans, relative to the rollers of Comparative Example 1. The rollers of Comparative Example 1 exhibited approximately 25% failure at about 22,500,000 life (cycles), whereas the roller of Example 1 exhibited approximately 25% failure at about 46,000,000 life (cycles). This improvement in surface contact fatigue performance may be attributed to the reheating conditions of the rollers of Example 1. Such reheating conditions helped yield rollers (Example 1) having finer grain diameters and increased carbide content, relative to the rollers of Comparative Example 1. Such features, in turn, contribute to the improvement of surface contact fatigue performance, as shown in FIG. 3.

INDUSTRIAL APPLICABILITY

In view of the above aspects of the present disclosure, it is possible to manufacture carburized steel components that may better withstand forces that cause unfavorable wear, pitting, spalling, etc. The dense carbide precipitation, fine prior austenite grain structure, and increased carbon content, among other characteristics of the carburized layer may be of particular benefit in steel components that commonly have contact fatigue applications such as gears, shafts, and those acting as bearings. This is because the aforementioned characteristics help enhance surface contact fatigue performances of carburized steel components relative to steel components utilizing conventional carburizing techniques or other conventional heat treatment techniques.

As a result, the above described carburized steel components may have longer surface contact fatigue lifespans, despite being exposed to similar wear forces. Furthermore, carburized steel components of the present disclosure may also decrease the likelihood of mechanical failure of machineries and devices employing such components. Accordingly, the present disclosure has significant industrial applicability.

It will be apparent to those skilled in the art that various modifications and variations can be made to the disclosed machine without departing from the scope of the disclosure. Other embodiments of the control system for a machine will be apparent to those skilled in the art from consideration of the specification and practice of the control system for a machine disclosed herein. It is intended that the specification and examples be considered as exemplary only, with a true scope of the disclosure being indicated by the following claims and their equivalents.

The invention claimed is:

1. A carburized steel component, comprising:

a steel base including, by weight percent, from 0.18% to 0.23% carbon, 0.8% to 1.20% manganese, 0% to 0.35% silicon, 0.65% to 1.0% chromium, 0.15% to 0.45% nickel, 0.15% to 0.45% molybdenum, 0% to 0.06% niobium, and a remaining weight percent of iron; and a carburized layer of above 0.35% by weight carbon from a surface of the carburized layer to a carburized layer depth, wherein the carburized layer depth is from 0.5 mm to 3.0 mm, wherein the carburized layer comprises a microstructure including martensite, retained austenite, carbide, and less than 2% by volume non-martensitic transformation products (NMTP), and wherein the carburized layer includes a prior austenite average grain size of 3.0-8.0 microns from the surface to a depth of at least 0.2 mm, wherein the carburized layer further includes a carbide particle count over 350 per a 200 square micron field from the surface of the carburized layer to the depth of 0.2 mm.

2. The carburized steel component of claim 1, wherein the carburized layer further includes a carbide particle count from 400 to 500 per a 200 square micron field as measured at a depth of 0.1 mm from the surface.

3. The carburized steel component of claim 1, wherein the carburized layer further includes a carbide area fraction over 7.5% from the surface of the carburized layer to the depth of 0.2 mm.

4. The carburized steel component of claim 1, wherein the carburized layer further includes a carbide area fraction from 7.5% to 15% from the surface of the carburized layer to a depth from 0.1 mm to 0.2 mm.

5. The carburized steel component of claim 1, wherein the carburized layer has a HRC surface hardness of at least 63, and a microhardness (HV) of at least 772, taken on a cross-section from the surface of the carburized layer to the depth of 0.2 mm.

6. The carburized steel component of claim 1, wherein 70% of carbides of the carburized layer have a minimum area of 0.01 $\mu m^2$ to 0.10 $\mu m^2$ from the surface of the carburized layer to a depth from 0.05 mm to 0.2 mm.

7. A carburized steel component, comprising:

a steel base including, by weight percent, from 0.18% to 0.23% carbon, 0.8% to 1.20% manganese, 0% to 0.35% silicon, 0.65% to 1.0% chromium, 0.15% to 0.45% nickel, 0.15% to 0.45% molybdenum, 0% to 0.06% niobium, and a remaining weight percent of iron; and a carburized layer, wherein the carburized layer extends from a surface of the carburized layer to a depth from 0.5 mm to 3.0 mm, wherein the carburized layer comprises a microstructure including 70-90% by volume of martensite, retained austenite, at least 7% by volume of carbide, and less than 2% by volume non-martensitic transformation products (NMTP), wherein the carburized layer further includes a carbide area fraction over 10% from the surface of the carburized layer to a depth of 300 microns, and wherein the martensite has a needle length of 1 to 5 microns.

8. The carburized steel component of claim 7, wherein the carburized layer includes a prior austenite average grain size of 3.0-8.0 microns from the surface to a depth of at least 0.2 mm.

9. The carburized steel component of claim 7, wherein the carburized layer further includes a carbide particle count over 350 per a 200 square micron field from the surface of the carburized layer to the depth of 0.2 mm.

10. The carburized steel component of claim 7, wherein the carburized layer further includes a carbide area fraction over 7.5% from the surface of the carburized layer to the depth of 0.2 mm.

11. The carburized steel component of claim 7, wherein the carburized layer has a HRC surface hardness of at least 63, and a microhardness (HV) of at least 772 from the surface of the carburized layer to the depth of 0.2 mm.

12. A method of manufacturing a carburized steel component, the method comprising:

selecting a steel material having, by weight percent, from 0.18% to 0.23% carbon, 0.8% to 1.20% manganese, 0% to 0.35% silicon, 0.65% to 1.0% chromium, 0.15% to 0.45% nickel, 0.15% to 0.45% molybdenum, 0% to 0.06% niobium, and a remaining weight percent of iron;

shaping the steel material to form a component;

carburizing the steel component in the temperature range of 900° C. to 1000° C. until forming a carburized layer 0.5-3.0 mm deep, and the carburized layer has a carbon content above 0.35%, by weight, of carbon, wherein the carburizing is in a hydrocarbon atmosphere with a carbon potential above 1.00;

cooling the carburized component to below 100° C.;

reheating the cooled carburized component at a temperature from 760° C. to 830° C., wherein the reheating is in a hydrocarbon atmosphere with a carbon potential near 1.00; and re-cooling the carburized steel component via quenching, wherein the carburized steel component is reheated and re-cooled so that the carburized layer includes a mean grain diameter of 5 microns to 6 microns.

13. The method of claim 12, wherein the cooling after the carburizing is via quenching, and wherein the carburized layer has a hardness of at least HRC 57 prior to the reheating.

14. The method of claim 12, wherein the atmosphere is an endothermic generated atmosphere with a composition including H2, N2, CO, CO2, and water vapor.

15. The method of claim 12, wherein the carburized steel component is reheated and re-cooled so that the carburized layer includes a carbide particle count over 350 per a 200 square micron field from a surface of the carburized layer to a depth of 0.2 mm.

16. The method of claim 15, wherein the carburized steel component is reheated and re-cooled so that the carburized layer further includes a carbide area fraction over 10% from a surface of the carburized layer to a depth of 300 microns.

17. The method of claim 12, wherein the carburized steel component is reheated without surface carbon falling below, by weight percent, 0.8%.

18. The method of claim 12, wherein the quenching is at a temperature from 0° C. to 200°.

19. The method of claim 12, wherein ammonia is added to the atmosphere during the reheating.

* * * * *